US009598953B2

(12) United States Patent
Ringgenerg et al.

(10) Patent No.: US 9,598,953 B2
(45) Date of Patent: Mar. 21, 2017

(54) SUBSEA DUMMY RUN ELIMINATION ASSEMBLY AND RELATED METHOD UTILIZING A LOGGING ASSEMBLY

(71) Applicant: Halliburton Energy Services, Inc., Houston, TX (US)

(72) Inventors: Paul David Ringgenerg, Frisco, TX (US); Daniel Dorffer, Houston, TX (US); Dalmo Massaru Wakabayashi, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/440,324

(22) PCT Filed: Dec. 14, 2012

(86) PCT No.: PCT/US2012/069778

§ 371 (c)(1),
(2) Date: May 1, 2015

(87) PCT Pub. No.: WO2014/092726

PCT Pub. Date: Jun. 19, 2014

(65) Prior Publication Data

US 2015/0275654 A1 Oct. 1, 2015

(51) Int. Cl.
*E21B 47/09* (2012.01)
*E21B 34/04* (2006.01)
(Continued)

(52) U.S. Cl.
CPC ..... *E21B 47/09* (2013.01); *E21B 33/061* (2013.01); *E21B 33/064* (2013.01); *E21B 34/045* (2013.01)

(58) Field of Classification Search
CPC ..... E21B 47/09; E21B 33/064; E21B 34/045
(Continued)

(56) References Cited

U.S. PATENT DOCUMENTS 2,809,435 A * 10/1957 Nicolson ..... E21B 19/09 114/144 R
4,731,744 A 3/1988 Harrell, Jr. et al.
(Continued)

FOREIGN PATENT DOCUMENTS

AU 2012390273 A1 9/2012
CA 1239091 A 7/1988
(Continued)

OTHER PUBLICATIONS

International Search Report and the Written Opinion of the International Searching Authority, or the Declaration, Aug. 23, 2013, PCT/US2012/069778, 9 pages, ISA/KR.
(Continued)

*Primary Examiner* — Amber Anderson
*Assistant Examiner* — Aaron Lembo
(74) *Attorney, Agent, or Firm* — Haynes and Boone, LLP

(57) ABSTRACT

A system and method to eliminate the need for a dummy run comprises a logging assembly to detect the position of one or more blow-out preventer ("BOP") rams and a hang off location. During a logging operation, the logging assembly logs the positions of the BOP rams and wear bushing. The logged positions are then used to determine the correct placement of the subsea test tree ("SSTT") in relation to its hanger. Thus, the need to perform a dummy run is eliminated because correct placement of the SSTT can be determined during routine logging operations.

12 Claims, 4 Drawing Sheets

(51) Int. Cl.
*E21B 33/06* (2006.01)
*E21B 33/064* (2006.01)

(58) Field of Classification Search
USPC ..... 166/336, 348
See application file for complete search history.

(56) References Cited

U.S. PATENT DOCUMENTS

| | | | | |
|---|---|---|---|---|
| 4,905,763 | A | 3/1990 | Sauer et al. | |
| 5,014,781 | A * | 5/1991 | Smith | E21B 19/00 166/384 |
| 5,194,859 | A * | 3/1993 | Warren | E21B 47/011 175/45 |
| 5,484,022 | A * | 1/1996 | Coutts | E21B 34/102 166/324 |
| 5,860,478 | A * | 1/1999 | Coutts | E21B 34/045 166/356 |
| 6,321,846 | B1 | 11/2001 | Rytlewski | |
| 7,062,960 | B2 * | 6/2006 | Couren | E21B 33/061 73/152.51 |
| 7,274,989 | B2 | 9/2007 | Hopper | |
| 9,091,153 | B2 * | 7/2015 | Yang | E21B 47/12 |
| 9,291,048 | B2 * | 3/2016 | MacPhail | E21B 47/14 |
| 2002/0121369 | A1 | 9/2002 | Allen | |
| 2005/0263281 | A1 | 12/2005 | Lovell et al. | |
| 2008/0110633 | A1 | 5/2008 | Trewhella | |
| 2009/0260829 | A1 | 10/2009 | Mathis | |
| 2012/0000646 | A1 | 1/2012 | Liotta et al. | |
| 2012/0312529 | A1 * | 12/2012 | Ringgenberg | E21B 41/00 166/250.01 |
| 2013/0284432 | A1 * | 10/2013 | MacPhail | E21B 47/14 166/250.01 |

FOREIGN PATENT DOCUMENTS

| | | | |
|---|---|---|---|
| CA | 2536451 | A1 | 8/2007 |
| EP | 0 256 178 | A1 | 2/1988 |

OTHER PUBLICATIONS

Australian Examination Report for Patent Application No. 2012396794, dated Dec. 17, 2015, 5 pages.
Extended Search Report for European Patent Application No. 12890140.2, dated May 9, 2016, 7 pages.
Stomp, et al., *Deepwater DST Planning and Operations From a DP Vessel*, Society of Petroleum Engineers Annual Technical Conference and Exhibition, Sep. 26-29, 2004, Houston, Texas, USA.

* cited by examiner

SUBSEA DUMMY RUN ELIMINATION ASSEMBLY AND RELATED METHOD UTILIZING A LOGGING ASSEMBLY

The present application is a U.S. National Stage patent application of International Patent Application No. PCT/US2012/069778, filed on Dec. 14, 2012, the benefit of which is claimed and the disclosure of which is incorporated herein by reference in its entirety.

FIELD OF THE INVENTION

The present invention relates generally to subsea operations and, more specifically, to a logging assembly and method for eliminating the dummy run utilized to properly space subsea test equipment within a blow-out preventer ("BOP").

BACKGROUND

During conventional drilling procedures, it is often desirable to conduct various tests of the wellbore and drill string while the drill string is still in the wellbore. These tests are commonly referred to as drill stem tests ("DST"). To facilitate DST, a subsea test tree ("SSTT") carried by the drill string is positioned within the BOP stack. The SSTT is provided with one or more valves that permit the wellbore to be isolated as desired, for the performance of DST. The SSTT also permits the drill string below the SSTT to be disconnected at the seabed, without interfering with the function of the BOP. In this regard, the SSTT serves as a contingency in the event of an emergency that requires disconnection of the drillstring in the wellbore from the surface, such as in the event of severe weather or malfunction of a dynamic positioning system. As such, the SSTT includes a decoupling mechanism to unlatch the portion of the drill string in the wellbore from the drill string above the wellbore. Thereafter, the surface vessel and riser can decouple from the BOP and move to safety. Finally, the SSTT typically is deployed in conjunction with a fluted hanger disposed to land at the top of the wellbore to at least partially support the lower portion of the drillstring during DST.

Before DST, however, proper positioning of the SSTT within the BOP is important so as to prevent the SSTT from interfering with operation of the BOP. In particular, if the SSTT is not correctly spaced apart from the hanger, proper functioning of the BOP rams may be inhibited. Moreover, the SSTT may be destroyed by the rams to the extent the rams are activated for a particular reason. Accordingly, a "dummy run" is conducted before DST to determine positioning of the SSTT within the BOP, and in particular the spacing of the fluted hanger from the SSTT so that the SSTT components are positioned between the BOP rams.

During conventional dummy runs, a temporary hanger with a painted pipe above it is run into the BOP, typically on jointed tubing. Once the temporary hanger lands within the BOP, the rams are closed on the painted pipe with sufficient pressure to leave marks that indicate their position relative to the landed hanger. The rams are then retracted, and the dummy string is retrieved uphole. Based upon the markings on the painted pipe, proper positioning of the SSTT within the BOP is determined and the spacing of the fluted hanger from the SSTT is accordingly adjusted at the surface to achieve the desired positioning when the SSTT is deployed in the BOP.

Although simplistic, there is at least one severe drawback to conventional dummy run operations. Making up the jointed tubing used in the dummy assembly is very time consuming. Given this, and the fact that some wells are drilled at ocean depths of up to 10,000 feet or deeper, it can take days to complete a single dummy run. At the present time, it is estimated that some floating rigs have a daily cost of upwards of 400,000 USD. Therefore, conventional dummy run operations are very expensive.

In view of the foregoing, there is a need in the art for cost-effective approaches to properly positioning of the subsea test equipment within the BOP.

DESCRIPTION OF ILLUSTRATIVE EMBODIMENTS

Illustrative embodiments and related methodologies of the present invention are described below as they might be employed in an assembly and method for eliminating dummy runs using a logging tool. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1:
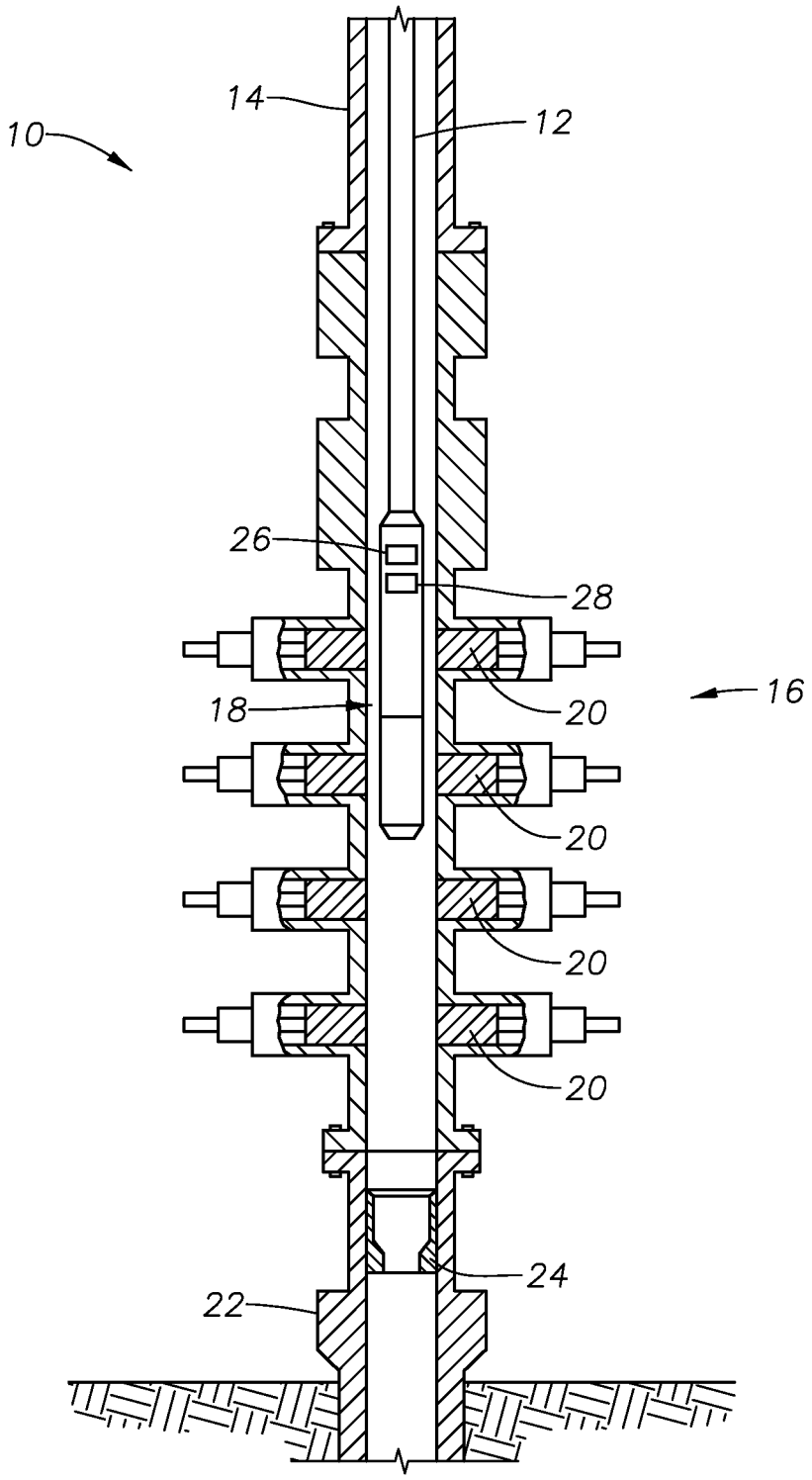
FIG. 1 illustrates a logging assembly utilized to eliminate a dummy run in accordance to certain exemplary embodiments of the present invention.

FIG. 1 illustrates a logging assembly 10 that eliminates the need for a dummy run, according to one or more exemplary embodiments of the present invention. As described herein, logging assembly 10 forms part of the assembly used to perform borehole logging operations. Since logging operations are performed prior to DST, use of the present invention eliminates the need to perform a dummy run. Instead, correct placement of the SSTT can be determined while performing standard logging operations, thus eliminating the additional, and time-consuming, downhole/uphole deployment of the dummy assembly.

In certain exemplary embodiments, logging assembly 10 is carried on a string (wireline 12, for example) which extends down through a body of water from a surface vessel (not shown), via a riser 14 connected to BOP 16. However, in other embodiments, logging assembly 10 may be carried on, for example, jointed pipe or coil tubing. BOP 16 includes a plurality of BOP rams 20, as understood in art, and is positioned atop wellbore 20. A wear bushing 24 is disposed at the top of wellbore 22. Logging assembly 10 includes a logging tool 18 utilized to detect and log one or more petrophysical characteristics of a borehole and surrounding geological formation, as will be understood by those ordinarily skilled in the art having the benefit of this disclosure. An exemplary logging tool may include, for example, the CAST-V™ Circumferential Acoustic Scanning Tool commercially offered by the Assignee of the present invention, Halliburton Energy Services, Inc. of Houston, Tex. Other examples may include the Electromagnetic Defectoscope™ commercially offered by GOWell Petroleum Equipment Co., Ltd. or other corrosion evaluation tools. Persons ordinarily skilled in the art having the benefit of this disclosure will realize there are a variety of logging tools which may be utilized within the present invention. Moreover, in certain exemplary embodiments, logging assembly 10 may be adapted to perform logging operations in both open and cased hole environments.

As described herein, logging tool 18 includes one or more sensors (not shown) that detect the position of one or more BOP rams 20 and wear bushing 24. Logging assembly 10 then logs the detected positions of the BOP rams 20 and wear bushing 24. Thereafter, as will be described below, the logged positions of BOP rams 20 and wear bushing 24 are used to determine the distance between them, thereby also determining the correct placement of the SSTT in relation to its hanger. Accordingly, through use of the present invention, the need to perform a dummy run is eliminated because correct placement of the SSTT can be determined during standard logging operations.

In certain exemplary embodiments, logging tool 18 may also be configured to detect petrophysical characteristics of wellbore 22, or other logging devices (not shown) along logging assembly 10 may be utilized for this purpose. Nevertheless, a CPU 26, along with necessary processing/storage/communication circuitry, forms part of logging tool 18 and is coupled to the logging sensors in order to process measurement data and/or petrophysical data, and communicate that data back uphole and/or to other assembly components via transmitter 28. In certain embodiments, CPU 26 calculates the distance between wear bushing 24 and one or more BOP rams 20 and stores the data in on-board storage. However, in other embodiments, the logged positions of wear bushing 24 and BOP rams 20 may be transmitted to a remote location (the surface, for example) and the calculations performed there. Moreover, in yet another alternative embodiment, CPU 26 may be located remotely from logging tool 18 and performs the processing accordingly. These and other variations within the present invention will be readily apparent to those ordinarily skilled in the art having the benefit of this disclosure.

Still referring to FIG. 1, the logging sensors utilized along logging tool 18 could take on a variety of forms such as, for example, acoustic (sonic or ultrasonic), capacitance, thermal, density, electromagnetic, inductive, dielectric, visual or nuclear, and may communicate in real-time. In other embodiments, a caliper tool having 2, 4, 6, or 8 arms, or a specialized multi-finger caliper (20, 40, 60 fingers, for example), might be utilized in logging tool 18. Such a caliper tool can be, for example, a simple mechanical two-arm tool, a multi-arm device forming part of a dipmeter or imager tool, a multi-arm caliper run with dipole sonic tools or a multi-finger caliper used for cased hole operations. In addition, the logging sensors may be adapted to perform, for example, cement evaluation and pipe inspection either simultaneously or in the same downhole trip. Transmitter 28 communicates with a remote location (surface, for example) using, for example, acoustic, pressure pulse, or electromagnetic methodologies, as will be understood by those ordinarily skilled in the art having the benefit of this disclosure.

In certain other exemplary embodiments, logging tool 18 may be equipped with an accelerometer (not shown) to enhance the accuracy of distance readings. The accelerometer may be positioned anywhere within logging tool 18 to provide a very accurate delta depth when logging up or down through wear bushing 24 and BOP 16. In one exemplary embodiment, logging tool 18 would be stopped below wear bushing 24 and then the logging would begin. The accelerometer would provide accurate delta depth information in the area of interest as logging tool 18 were slowly raised. However, in another embodiment, the logging may be conducted while moving logging tool 18 in the downward direction, as will be understood by those ordinarily skilled in the art having the benefit of this disclosure.

Figure 2A:
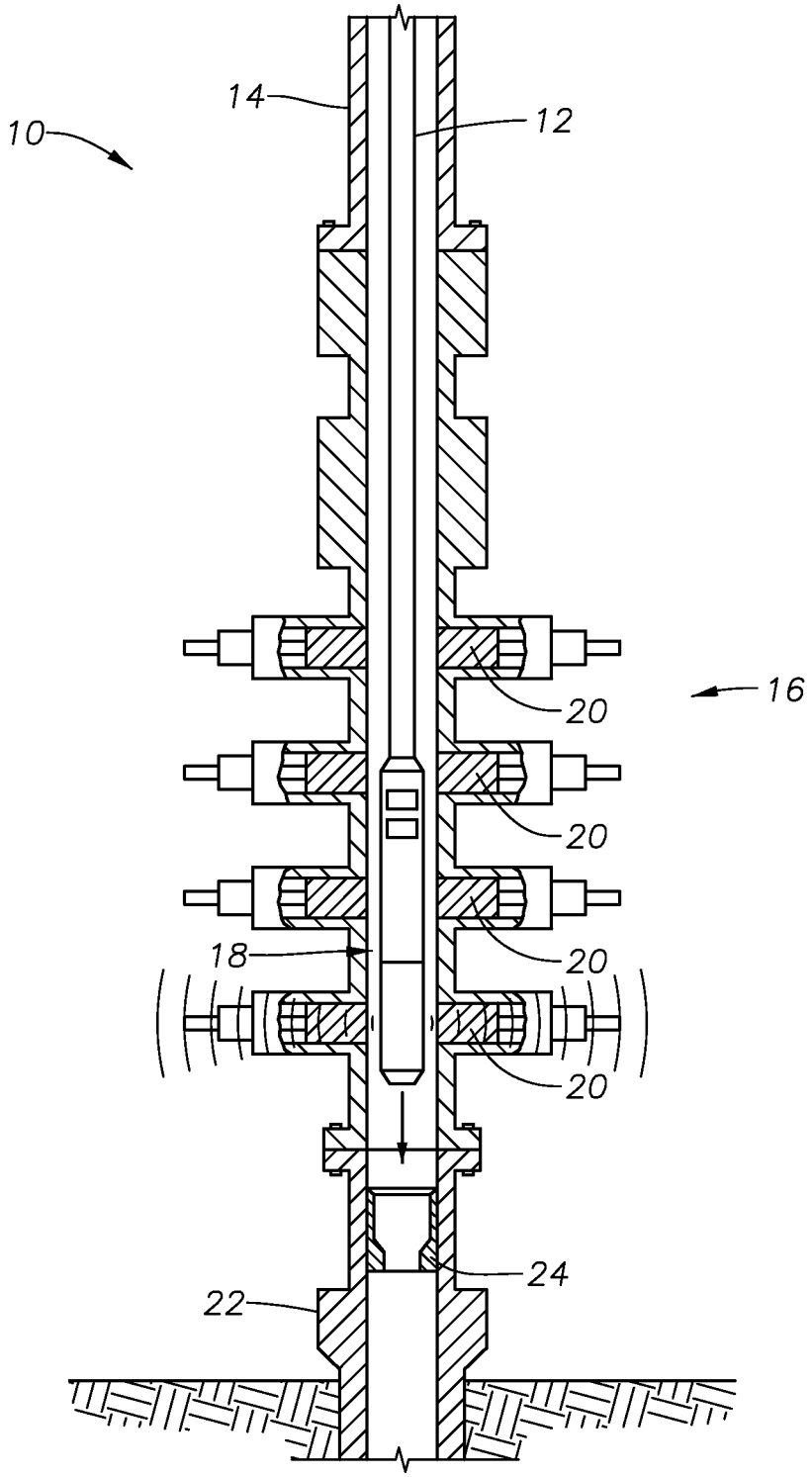
FIGS. 2A-2B illustrate a method whereby proper placement of an SSTT within a BOP is determined, in accordance to certain exemplary methodologies of the present invention.
Figure 2B:
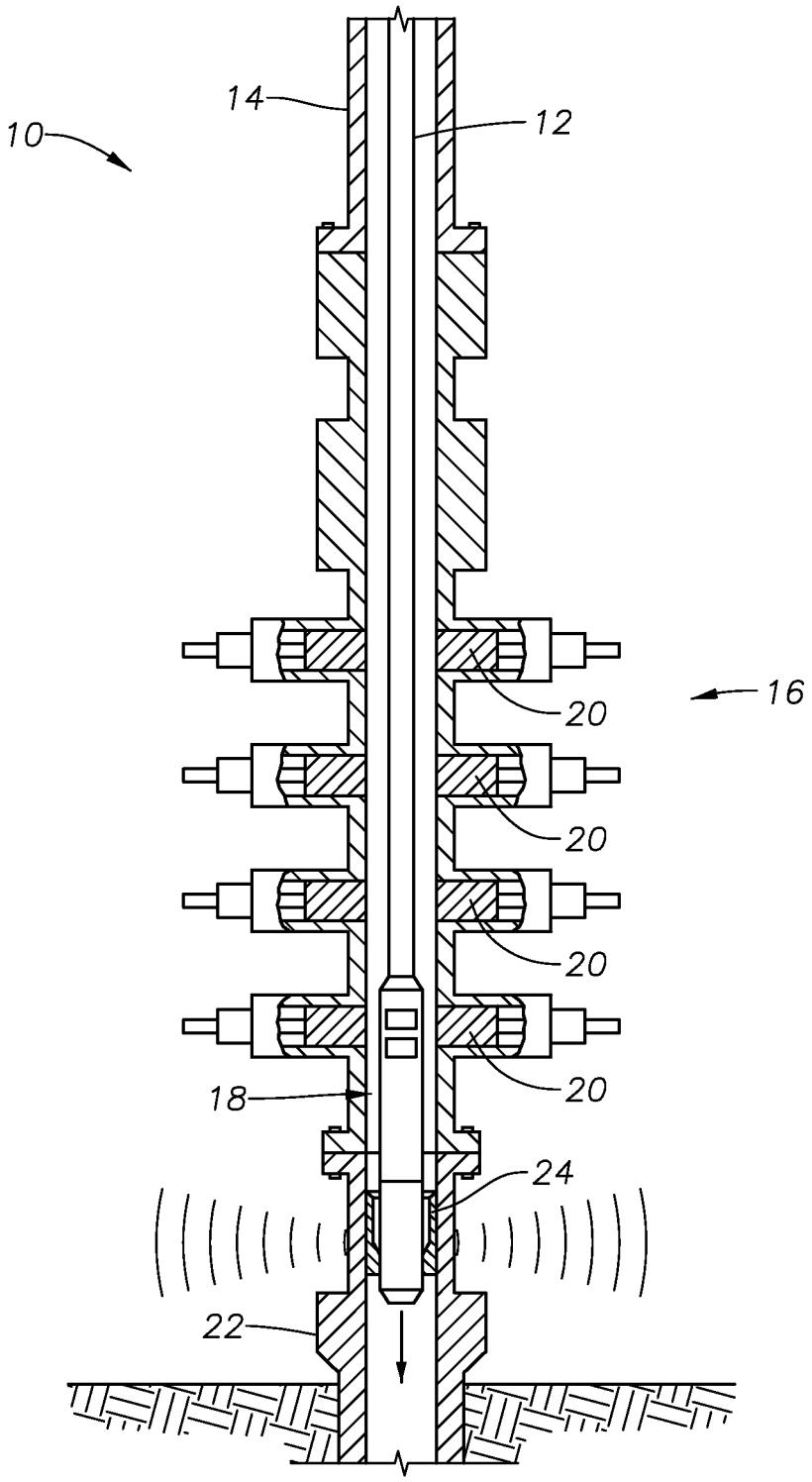

Referring now to FIGS. 2A and 2B, an exemplary operation utilizing the present invention will now be described. When it is desired to perform a logging operation, logging assembly 10 is deployed downhole using, for example, wireline 12. As logging assembly 10 continues its descent, it is eventually passed through BOP 16, BOP rams 20, and the hang off location (wear bushing 24). While doing so, logging tool 18 detects and logs the position of at least one BOP ram 20 and wear bushing 24. In this example as shown in FIG. 2A, logging tool 18 first detects and logs the position of the lowermost BOP ram 20. As it continues to be lowered, it encounters wear bushing 24 where it again detects and logs its position (FIG. 2B). CPU 26 may utilize the logged positions to calculate the distance between one or more BOP rams 20 and wear bushing 24, and store the logged positions and calculations accordingly. However, in other embodiments, CPU 26 may transmit the logged positions in real-time, via transmitter 28, to a remote location where the distance is calculated. Also note that logging assembly 10 may log the positions of BOP rams 20 and wear bushing 24 during its uphole assent in other embodiments, as understood in the art.

Moreover, in certain embodiments, the logged positions of a single BOP ram 20 may be utilized to determine the correct placement of the SSTT within BOP 16. However, in other embodiments, the logged positions of multiple BOP rams 20 and/or wear bushing 24 may be used together to determine the correct placement. Those ordinarily skilled in the art having the benefit of this disclosure will realize that the position of one or more of the rams or the wear bushing may be utilized alone or together to determine correct placement of the SSTT and BOP 16.

Thereafter, logging assembly 10 may be further deployed downhole to perform other logging operations such as, for example, logging one or more characteristics of the geological formation. After all logging operations have concluded, logging assembly 10 is retrieved back uphole to the surface. Then, using the logged positions of BOP rams 20 and wear bushing 24, the SSTT hanger may then be adjusted accordingly. In the alternative, the SSTT assembly may simply be made up based upon the logged positions, thus requiring no adjusting of the hanger. Moreover, the SSTT may be made up or adjusted in real-time as the logged data is transmitted from logging assembly 10, thus saving even more time. Nevertheless, the SSTT assembly, which includes the SSTT hanger, is then deployed downhole where the SSTT hanger is landed in wear bushing 24. Thereafter, DST operations may be conducted as understood in the art.

Figure 3:
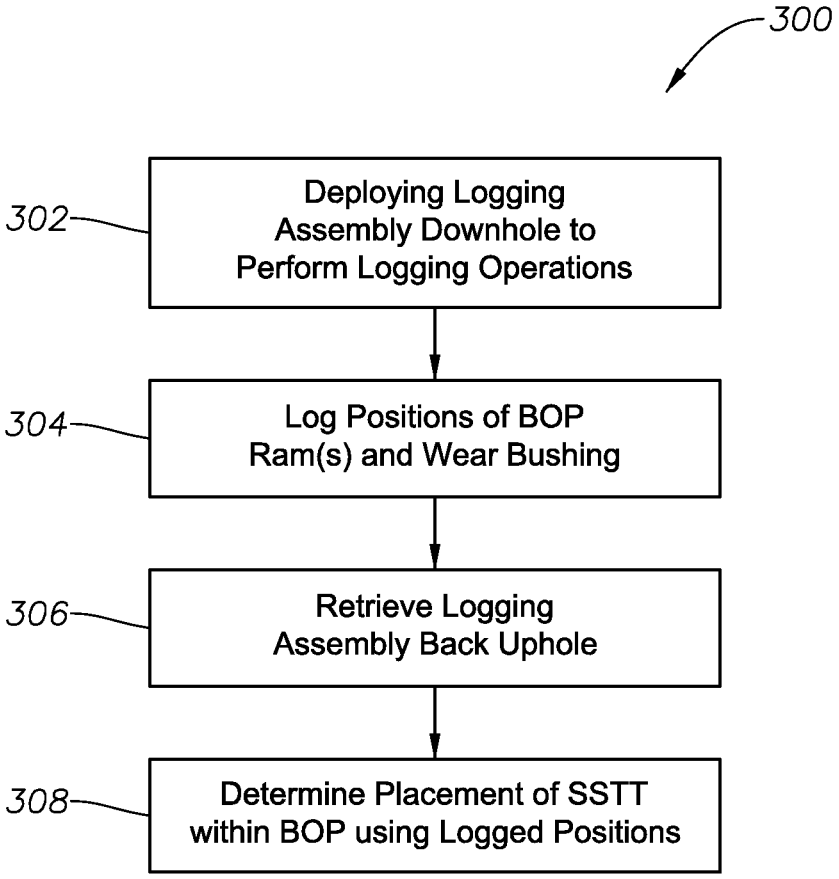
FIG. 3 is a flow chart illustrating a method whereby proper placement of an SSTT within a BOP is determined, in accordance to certain exemplary methodologies of the present invention.

FIG. 3 is a flow reflecting one or more exemplary methodologies of the present invention whereby proper placement of a SSTT within a BOP is determined during a routine logging operation. At block 302, logging assembly 10 is deployed downhole. In one methodology, logging assembly 10 is first deployed to the bottom of the formation or zone of interest, and logging operations are performed in an uphole fashion. However, in another methodology, the logging operation is performed in a downhole fashion. Nevertheless, at block 304, the position of at least one of BOP rams 20 and wear bushing 24 is logged by logging assembly 10, thereby generating one or more logged positions. Thereafter, further logging operations may be conducted in the same downhole run. At block, 306, logging assembly 10 is then retrieved back uphole. At block 308, proper placement of the SSTT within BOP 16 is then determined based upon the one or more logged positions of the BOP ram(s) 20 and wear bushing 24.

In view of the foregoing, an exemplary methodology of the present invention provides a method to determine placement of a SSTT within a BOP, the method comprising positioning a logging assembly along a string, the logging assembly comprising a logging tool; deploying the logging assembly downhole; passing the logging assembly through a BOP and past a hang off location; logging a position of at least one BOP ram and the hang off location; retrieving the logging assembly uphole; and determining a placement of the SSTT within the BOP using the logged positions of the at least one BOP ram and the hang off location. Another method comprises adjusting a hanger of the SSTT based upon the logged positions of the at least one BOP ram and the hang off location, deploying the SSTT downhole and landing the hanger of the SSTT at the hang off location. In yet another, logging the position of the at least one BOP ram and the hang off location further comprises calculating a distance between the at least one BOP ram and the hang off location.

In another method, logging the position of the at least one BOP ram and the hang off location further comprises transmitting the logged positions to a remote location in real-time. In yet another, logging the position of the at least one BOP ram and the hang off location further comprises storing the logged positions within circuitry located in the logging assembly. In another method, logging the position of the at least one BOP ram and the hang off location further comprises logging one or more characteristics of a downhole geological formation.

Yet another exemplary methodology of the present invention provides a method to determine placement of a SSTT within a BOP, the method comprising deploying a logging assembly downhole; logging a position of at least one of a BOP ram or a hang off location, thus generating one or more logged positions; retrieving the logging assembly uphole; and determining a placement of the SSTT within the BOP using the one or more logged positions. In another, deploying the logging assembly downhole further comprises positioning the logging assembly on a wireline. Yet another method comprises adjusting a hanger of the SSTT based upon the one or more logged positions, deploying the SSTT downhole and landing the hanger of the SSTT at the hang off location.

In another method, generating the one or more logged positions further comprises calculating a distance between at least one BOP ram and the hang off location. In yet another, generating the one or more logged positions further comprises further comprises transmitting the one or more logged positions to a remote location in real-time. In another method, generating the one or more logged positions further comprises storing the one or more logged positions within circuitry located in the logging assembly.

An exemplary embodiment of the present invention provides an assembly to determine placement of a SSTT within a BOP, the assembly comprising a string extending from a surface location and a logging tool positioned along the string and configured to log a position of at least one of a BOP ram or a hang off location, whereby placement of the SSTT within the BOP is determined based upon the logged position In another embodiment, the assembly is further adapted to log one or more characteristics of a downhole geological formation. In yet another, the assembly further comprises a transmitter disposed to transmit the logged position in real-time to a remote location. In yet another, the assembly further comprises circuitry to calculate a distance between the BOP ram and the hang off location. In another, the assembly further comprises circuitry to store the logged position. In yet another, the string is a wireline, jointed pipe or coiled tubing.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies, and will be understood to include all modifications and variations as would be apparent to one ordinarily skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A method to determine placement of a subsea test tree ("SSTT") within a blow out preventer ("BOP"), the method comprising:

positioning a logging assembly on a string, the logging assembly comprising a logging tool;

deploying the logging assembly downhole;

passing the logging assembly through the BOP and past a hang off location;

logging a position of at least one BOP ram and the hang off location using the logging tool positioned on the string;

retrieving the logging assembly uphole;

determining a placement of the SSTT within the BOP using the logged positions of the at least one BOP ram and the hang off location; and positioning the SSTT within the BOP.

2. A method as defined in claim 1, wherein positioning the SSTT within the BOP comprises:

adjusting a hanger of the SSTT based upon the logged positions of the at least one BOP ram and the hang off location;

deploying the SSTT downhole; and landing the hanger of the SSTT at the hang off location.

3. A method as defined in claim 1, wherein logging the position of the at least one BOP ram and the hang off location further comprises calculating a distance between the at least one BOP ram and the hang off location.

4. A method as defined in claim 1, wherein logging the position of the at least one BOP ram and the hang off location further comprises transmitting the logged positions to a remote location in real-time.

5. A method as defined in claim 1, wherein logging the position of the at least one BOP ram and the hang off location further comprises storing the logged positions within circuitry located in the logging assembly.

6. A method as defined in claim 1, wherein logging the position of the at least one BOP ram and the hang off location further comprises logging one or more characteristics of a downhole geological formation.

7. A method to determine placement of a subsea test tree ("SSTT") within a blow out preventer ("BOP"), the method comprising:

deploying a logging assembly downhole on a string;

logging a position of at least one of a BOP ram or a hang off location using the logging assembly positioned on the string, thus generating one or more logged positions;

retrieving the logging assembly uphole;

determining a placement of the SSTT within the BOP using the one or more logged positions; and positioning the SSTT within the BOP.

8. A method as defined in claim 7, wherein deploying the logging assembly downhole further comprises positioning the logging assembly on a wireline.

9. A method as defined in claim 7, wherein positioning the SSTT within the BOP comprises:

adjusting a hanger of the SSTT based upon the one or more logged positions;

deploying the SSTT downhole; and landing the hanger of the SSTT at the hang off location.

10. A method as defined in claim 7, wherein generating the one or more logged positions further comprises calculating a distance between at least one BOP ram and the hang off location.

11. A method as defined in claim 7, wherein generating the one or more logged positions further comprises transmitting the one or more logged positions to a remote location in real-time.

12. A method as defined in claim 7, wherein generating the one or more logged positions further comprises storing the one or more logged positions within circuitry located in the logging assembly.

* * * * *